US005331702A

United States Patent [19]

Willsey et al.

[11] Patent Number: 5,331,702

[45] Date of Patent: Jul. 26, 1994

[54] GOLF BALL WASHING APPARATUS AND METHOD

[76] Inventors: Charles H. Willsey, Rte. 1, Box 310; Virgil S. Willsey, Rte. 1, Box 304, both of, Maple Hill, Kans. 66507

[21] Appl. No.: 996,650

[22] Filed: Dec. 24, 1992

[51] Int. Cl.[5] ..... A63B 47/04

[52] U.S. Cl. ..... 15/21.2; 15/3.13; 15/3.15; 15/3.16; 15/3.17; 134/131

[58] Field of Search ..... 15/21.2, 3.13–3.18; 134/83, 133, 131, 127, 126

[56] References Cited

U.S. PATENT DOCUMENTS

| | | | |
|---|---|---|---|
| 1,055,121 | 3/1913 | Becker | 15/3.16 |
| 1,776,784 | 9/1930 | Cramer | 15/3.16 |
| 1,852,405 | 5/1932 | Farley | 134/131 |
| 2,183,033 | 12/1939 | Segrin | 15/3.16 |
| 2,267,641 | 12/1941 | Chater | 15/3.17 |
| 2,273,020 | 2/1942 | Chater | 15/3.17 |
| 2,376,587 | 5/1945 | Diller | 15/3.17 |
| 2,578,944 | 12/1951 | Ramont | 15/3.17 |
| 2,714,257 | 8/1955 | Reading | 134/131 |
| 2,931,053 | 4/1960 | Knudsen | 15/21.2 |
| 2,931,058 | 4/1957 | Knudsen | 15/21.2 |
| 3,099,848 | 8/1963 | Mountz | 15/3.14 |
| 3,120,669 | 6/1962 | Montuori | 15/21.2 |
| 3,283,523 | 11/1966 | Long | 134/131 |
| 3,733,633 | 5/1973 | Gustafson | 15/21.2 |
| 3,820,183 | 6/1974 | Gustafson et al. | 15/21.2 |
| 4,181,996 | 1/1980 | Hollrock | 15/21.2 |
| 4,773,114 | 9/1988 | Thrasher | 15/21.2 |
| 4,805,251 | 2/1989 | Hollrock | 15/21.2 |
| 5,033,158 | 7/1991 | Petho | 134/131 |
| 5,077,854 | 1/1992 | Moons | 15/21.2 |

OTHER PUBLICATIONS

Wittek 1991–1992 Golf Equipment Catalog, pp. 11–13 for golf ball washers.

Easy Picker Golf Products Inc. Sales Flyer for golf ball washer.

Hollrock Engineering Brochure for "Range Sevant" equipment and golf ball washers.

Professional Sports Marketing Inc. Broachure for "Range Master" golf ball washers.

*Primary Examiner*—Timothy F. Simone
*Assistant Examiner*—Patrick Brinson
*Attorney, Agent, or Firm*—Litman, McMahon & Brown

[57] ABSTRACT

A golf ball washing apparatus and method includes a bin and a conveyor which takes rows of golf balls from the bin and conveys them up an inclined ramp. A plurality of reciprocating brush heads clean the balls and a fluid spray head sprays cleaning fluid onto the balls as they advance up the ramp. Golf balls which exit the top of the ramp reach a gate where they are alternatively recirculated through the washing apparatus or directed out to a storage bin. The entire wash operation is clearly visible to an operator so that he can readily determine when the balls have been cleaned sufficiently to warrant opening the gate.

14 Claims, 2 Drawing Sheets

73
72
86
71
73
95
61
41
34
15
32
111
85
61
31
36
23
37
25
33
94
24
42
21
104
44
102
101
103
104
5
22
43

GOLF BALL WASHING APPARATUS AND METHOD

BACKGROUND OF THE INVENTION

1. Field Of the Invention

This invention is directed to a golf ball washing system for washing large numbers of golf balls for a driving range or the like, and more particularly to such a system in which golf balls in a bin are picked up and fed by a conveyor up an inclined ramp past a pair of reciprocating brushes and a spray nozzle and then selectively returned for further washing.

2. Description of the Related Art

Operators of golf driving ranges and other establishments, such as large miniature golf course complexes and the like, are faced with the problem of collecting golf balls after they are used by customers and cleaning the collected balls for further use. Golf balls used in golf driving ranges in particular tend to get very dirty and are often covered with grass and mud stains. A large driving range can collect and redistribute literally thousands of golf balls during a single day. An efficient system for cleaning these collected balls is absolutely necessary since driving range customers desire and expect clean golf balls.

Numerous attempts have been made to produce a suitable golf ball washer for driving ranges and the like. For example, U.S. Pat. No. 2,931,058 to Knudsen teaches a bin into which a quantity of water and a plurality of golf balls are placed. A rotary wheel with a number of ball partitions spins through the bin and picks up golf balls. A cooperating rotary brush then brushes the balls in the wheel, which are then returned to the bin. U.S. Pat. No. 3,120,669 to Montuori teaches a tumbling and scrubbing drum with "scrubbing bars" through which dirty balls are passed for cleaning. U.S. Pat. No. 3,733,633 to Gustarson teaches a ball cleaning apparatus with a rotating drum in which a pair of opposing brushes clean balls placed into the drum. U.S. Pat. No. 3,820,183 to Gustafson et al. also teaches a ball washer with a scrubbing drum. A spray system sprays the balls as they are fed into the drum from a hopper. U.S. Pat. No. 4,181,996 to Hollrock teaches a golf ball scrubbing drum with a helical ball feeder for feeding golf balls through a scrubbing chamber. U.S. Pat. No. 4,773,114 to Thrasher teaches a golf ball washer with a brush rotating in a water tank. A helical steel band feeds balls past the brush. U.S. Pat. No. 4,805,251 to Hollrock teaches a golf ball washer with a wire basket hopper which feeds balls into a drum containing rotating brushes. A plurality of track segments feed the balls past the brushes and out of the drum.

In virtually all of the prior art golf ball washers, the action of a rotary drum, a rotary brush, or both is used to clean the golf balls. Often the balls are fed only once through the apparatus and, if they are not cleaned sufficiently, must be loaded and fed through again. Furthermore, the rotary action of the drums and/or brushes tends to damage the balls by smashing them into each other and to abrasive particles of sand and debris at high speeds. This can shorten the useful life of driving range balls, which can represent a substantial expense. Lastly, most prior art washers are at least partially enclosed, making it nearly impossible to determine when the balls are cleaned sufficiently, even when a recirculating system is included.

It is apparent, then, that a golf ball washer which solves the above-mentioned problems is needed. Such a washer should have a recirculating system so that the balls can be washed until clean, should avoid a rotary action which tends to damage the balls and reduce their useful life, and should make the cleaning process visible so that an operator can readily determine when the recirculating balls have been sufficiently cleaned.

SUMMARY OF THE INVENTION

In the practice of the present invention, an endless link-type conveyor collects golf balls from a bin and conveys them in single layer rows up an inclined ramp. A pair of reciprocating brushes contact the golf balls on the conveyor as they are moved up the ramp. The brushes have a concave shape, which facilitates thorough cleaning of the balls. Cleaning fluid from a storage tank located below the ramp is pumped up into a fluid sprayer head which sprays cleaning fluid onto the balls as they are conveyed up the ramp. The fluid then runs down the ramp and drains back into the storage tank. Any golf balls in excess of a single layer on the conveyor are pushed back down into the bin by the action of the brushes. This insures that each ball is thoroughly brushed as it advances up the ramp. As the balls exit the top of the ramp, they enter a return ramp with a hinged gate where they are either recirculated back to the bin for further washing, or out of the apparatus and into a storage container if they have been sufficiently cleaned, depending upon the position of the gate. The balls are readily visible to an operator during the washing procedure so it is easy to see when they have been thoroughly cleaned.

OBJECTS AND ADVANTAGES OF THE INVENTION

The principle objects and advantages of the present invention include: to provide an improved golf ball washing apparatus and method; to provide such a washing method in which golf balls from a storage bin are collected and conveyed up an inclined ramp by a conveyor; to provide such an apparatus in which one or more reciprocating concave brushes clean the balls as they are conveyed up the ramp; to provide such an apparatus in which cleaning fluid is sprayed onto the balls as they are brushed; to provide such an apparatus in which the balls are selectively recycled through the bin and conveyor until they are clean; to provide such an apparatus in which the washing operation is readily visible to an operator so that it is easy to determine when the balls have been sufficiently cleaned; to provide such a method which avoids damaging the balls as they are cleaned; and to provide such an apparatus and method which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
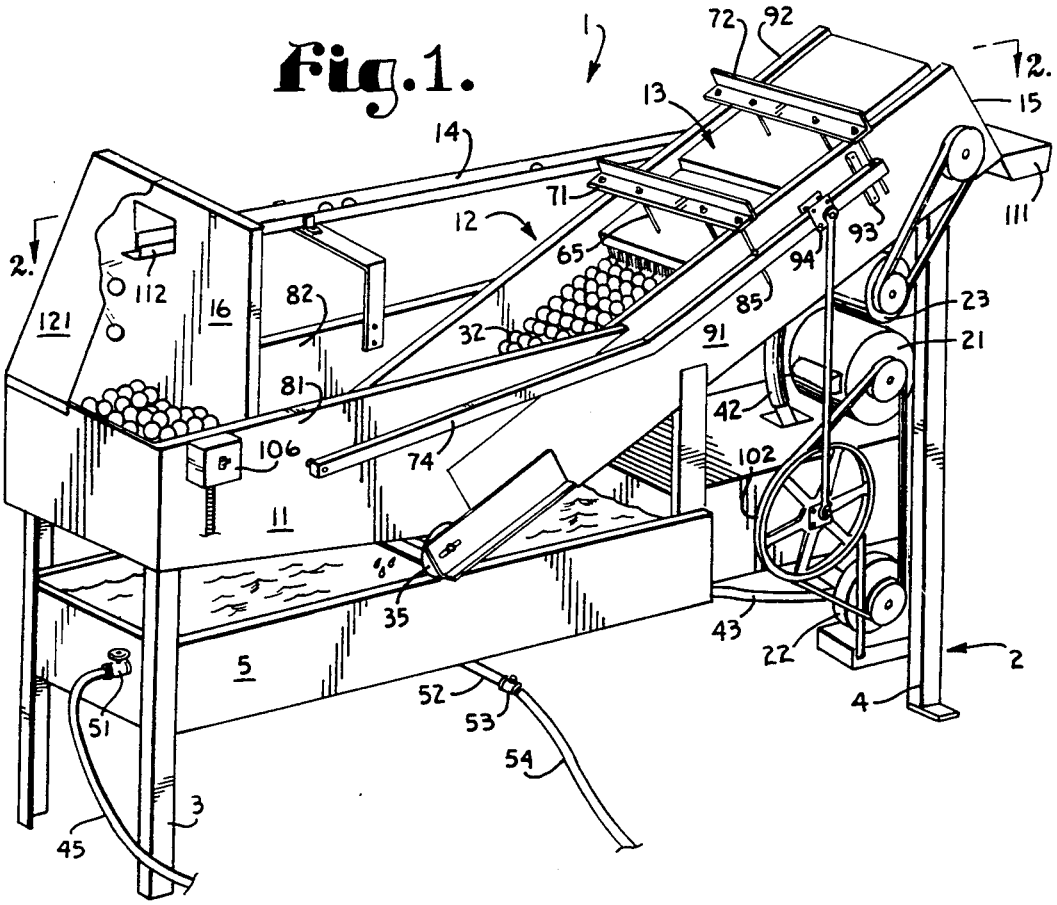
FIG. 1 is a perspective view of a golf ball cleaning apparatus in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail the reference numeral 1 in FIG. 1 generally designates a golf ball washing apparatus in accordance with the present invention. The washing apparatus 1 comprises a frame 2 comprising a pair of short frame legs 3 and a pair of longer frame legs 4. A cleaning fluid tank 5 is connected at one end to the middle of the short frame legs 3. A golf ball storage bin 11 is attached at one end to the top of the short frame legs 4 and a ramp and conveyor assembly 12 is connected between the other end of the storage bin 11 and the longer frame legs 4. The other end of the fluid tank 5 is supported by the ramp and conveyor assembly 12.

A reciprocating brush assembly 13 is disposed within the ramp and conveyor assembly 12 and a ball return chute 14 is connected between an upper end 15 of the ramp and conveyor assembly 12 and a vertical plate 16 within the ball storage bin 11. An electric motor 21 is connected to drive both the reciprocating brush assembly 13 and a water pump 22 and a motor 23 is connected to drive the ramp and conveyor assembly 12.

II. Ramp and Conveyor Assembly and Cleaning Fluid Supply

Figure 2:
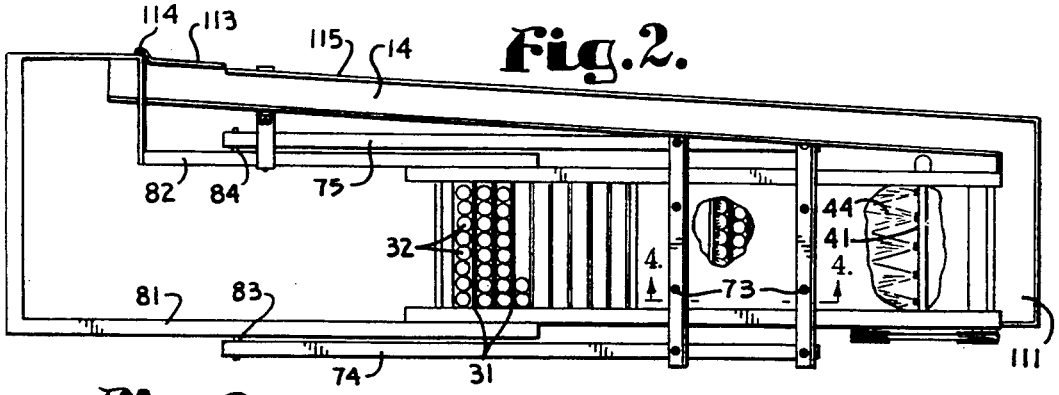
FIG. 2 is a top plan cross-sectional view of the cleaning apparatus, taken along line 2—2 of FIG. 1, with portions of the housing broken away to illustrate the cleaning brushes and the fluid sprayer.
Figure 5:
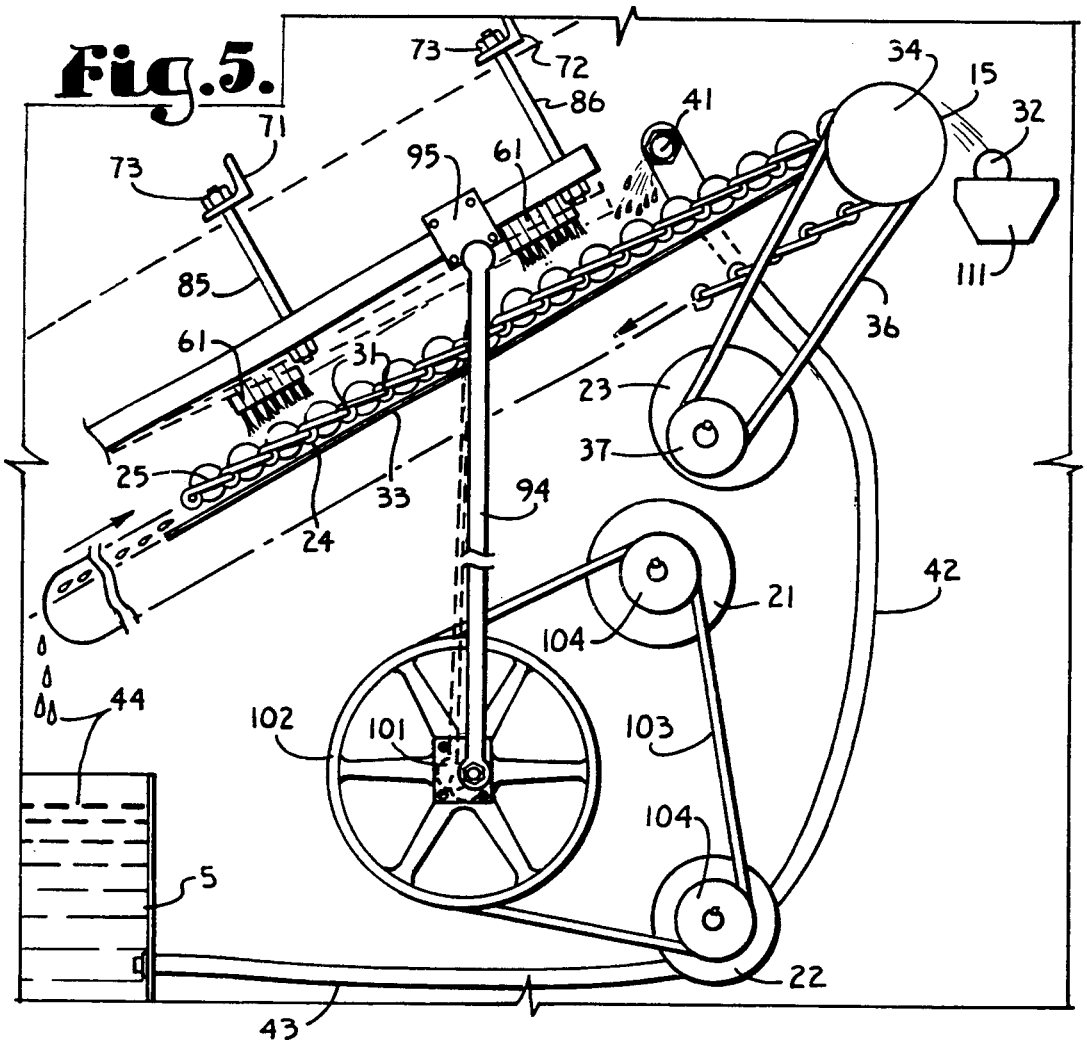
FIG. 5 is an enlarged, fragmentary and partially schematic side elevational view of the cleaning apparatus illustrating the fluid pumping system and the mechanical drive structure for the conveyor and the brushes.

Referring in particular to FIGS. 1, 2 and 5, the ramp and conveyor assembly 12 comprises an endless chain-type conveyor 24, which includes two opposed series of interconnected links 25, with corresponding links in the two chains connected to each other via a like plurality of connecting rods 31. The connecting rods 31 are spaced to accommodate a single row of golf balls 32 between each adjacent pair of rods 31. The conveyor 24 extends around an inclined ramp 33 (FIG. 5), a drive sprocket 34 at the top of the ramp 33, and a rotating idler sprocket 35 at the bottom of the ramp 33. The drive wheel 34 is driven by a V belt 36 connected to a drive pulley 37 on the motor 23. As the conveyor connecting rods 31 are drawn up through the ball storage bin 11, each adjacent pair of rods 31 picks up a separate row of the golf balls 32 and conveys them up the ramp 33. A fluid cleaner spray head 41 is connected to the pump 22 via a first hose 42. The pump 22 is, in turn, connected to the holding tank 5 via a second hose 43, whereby cleaning fluid 44 is pumped from the tank 5 to the spray head 41 and sprayed onto the golf balls 32. The fluid 44, which can be ordinary water, water mixed with a detergent, or any other suitable cleaning fluid, can be pumped into the tank 5 via a supply hose 45 and a connecting valve 51. Once the fluid 44 becomes too dirty to effectively clean, it can be conveniently drained via a drain pipe 52, a drain valve 53 and a drain hose 54. The cleaning fluid 44 which is sprayed onto the golf balls 32 via the spray head 41 runs down the ramp 33 and returns to the tank 5, as shown in FIG. 1.

III. Reciprocating Brush Assembly

Figure 4:
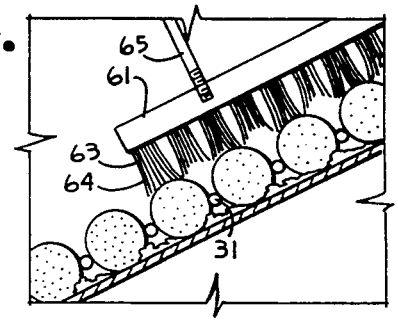
FIG. 4 is a further enlarged, fragmentary cross-sectional view of the cleaning apparatus, taken along line 4—4 of FIG. 2, illustrating the brushing action and the shape of the concave brushes.

The reciprocating brush assembly 13 comprises a plurality of brush heads 61, each of which comprise a number of separate brushes 63 arranged in rows and columns, as best shown in FIG. 4. Note that each separate brush 63 has a number of bristles 64, with the bristles 64 being graduated in size, i.e. the exterior bristles 64 being the longest and the innermost bristles 64 being the shortest. Thus, each of the brushes 63 presents a concave surface to the golf balls 32, which enhances the cleaning action on the entire perimeter of each of the balls 32. The brush heads 61 are connected to one end of a plurality of threaded rods 65, with the rods 65 rigidly connected at the other end to one of a pair of angle members 71 and 72 via nuts 73. A pair of arms 74 and 75 are connected at a first end to a pair of sidewalls 81 and 82 of the storage bin 11 via a pair of bolts 83 and 84, respectively. Each of the arms 74 and 75 are rigidly connected to a pair of rods 85 and 86, which are, in turn, connected to a respective one of the pair of angle members 71 and 72 in the same manner as the rods 65. Referring to FIG. 1, the arms 74 and 75 are also slidably connected near the second end to a pair of ramp sidewalls 91 and 92, respectively, via a pair of rails 93. The second end of each of the arms 74 and 75 is thus free to slide up and down on the rails 93. The arm 74 is connected to a top end of a piston rod 94 via a clamp 95. The other end of the piston rod 94 is eccentrically and pivotally connected to a center plate 101 of a pulley 102. The pulley 102 is rotatably driven via a belt 103, which is also connected to a drive pulley 104 on the motor 21 and a pulley 105 on the pump 22. As illustrated in FIG. 5, as the pulley 105 is rotated by the motor 21 via the belt 103, the eccentric connection of the piston rod 94 causes it to move up and down and from side to side, as shown in phantom lines. This forces the arm 74 up and down as well, which pushes the rods 85 and 86, and the angle members 71 and 72 up and down and side to side as well. This motion causes the brush heads 61 to reciprocate up and down and slightly side to side, which moves the bristles 64 against the surfaces of the balls 32 as the balls 32 are advancing up the ramp 33, thoroughly cleaning them. The reciprocating motion of the brushes 63 also rotates the balls 32, exposing all sides to the action of the brush bristles 64, and pushes any balls 32 in excess of a single layer back down into the bin 11. Both motors 21 and 23 are controlled by an electric switch 106, which can be mounted on the sidewall 81 of the storage bin 11, or at any other desired location. For simplicity of illustration, the electrical supply wires are not shown in their entirety. Of course, the motors 21 and 23 can be independently controlled, if desired.

IV. Golf Ball Return Chute and Gate

Figure 3:
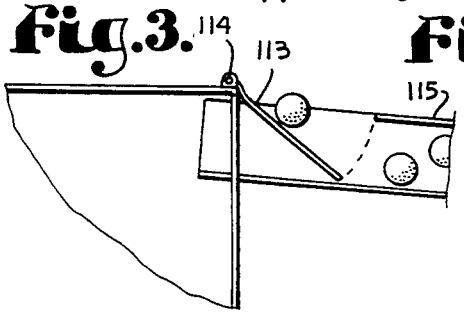
FIG. 3 is an enlarged and fragmentary top plan view, illustrating a gate for alternatively directing cleaned balls to be recirculated or out of the apparatus.

The return chute 14 includes a catch basin 111 which is positioned to catch the golf balls 32 as they exit the top end 15 of the ramp 33. The basin 111 and the return chute 14 are slightly inclined, which causes the balls 32 to roll down the basin 111 to the chute 14 and then down the chute 14 toward an exit end 112. A gate 113 is positioned near the exit end 112, and the gate 113 is connected to the ramp 14 via a hinge 114. The gate 113 is normally aligned with a side wall 115 of the ramp 14, which allows the balls 32 to roll off of the exit end 112 of the ramp 14 and back into the storage bin 11, as shown in FIG. 1. A shield 121, shown partially broken away, is positioned to intercept the exiting balls 32 and deflect them into the bin 11. Referring again to FIG. 3, when an operator determines that the golf balls are sufficiently clean, he pivots the gate 113 to a position across the ramp 14, which causes the golf balls to exit the side of the ramp 14 and into a clean ball storage container (not shown).

V. Operation

The operation of the golf ball washing apparatus 1 will now be described with reference to FIGS. 1–5. A number of dirty golf balls 32 are loaded into the storage bin 11 after having been retrieved from a driving range or the like. The tank 5 is partially filled with the cleaning fluid 44 and the switch 106 is turned on, thus starting the motors 21 and 23. The motor 23 drives the drive sprocket 34, which causes the conveyor 24 to move up the top side of the ramp 33 and down the bottom side of the ramp 33, as shown by the arrows in FIG. 5. The conveyor connecting rods 31 thus retrieve rows of the balls 32 as the rods 31 are drawn through the bin 11. At the same time, the motor 21 is rotatably driving the pulley 102 and the fluid pump 22. The pulley 102, through the eccentric connection of the piston rod 94, the arms 74 and 75, the rods 85, 86, and 65, and the angle members 71 and 72, drives the brushes 63 in a reciprocating fashion over the golf balls 32 in the conveyor 24. Simultaneously, cleaning fluid 44 is pumped form the storage tank 5 through the pump 22, out the spray heads 41 and onto the rows of balls 32. Once the balls reach the top 15 of the ramp 33, they are circulated back to the storage bin 11 via the catch basin 111 and the ramp 14. Thus, the balls 32 are continuously washed and rewashed until an operator determines that they are sufficiently clean, at which point he opens the gate 113 and empties all of the clean balls 32 out of the washing apparatus 1. At this point, additional balls 32, and, if necessary, clean fluid 44 can be introduced into the apparatus 1 for another wash cycle.

It is to be understood that while certain forms of the present invention have been illustrated and described herein, it is not to be limited to the specific forms or arrangement of parts described and shown.

What is claimed and desired to be secured by Letters Patent is as follows:

1. A ball washing apparatus comprising:
(a) an inclined ramp means;
(b) a ball storage bin;
(c) a conveyor means for conveying a plurality of balls to be washed up said ramp means, said conveyor means extending into said ball storage bin and picking up rows of balls therefrom, said conveyor means comprising:
(i) an opposed pair of endless chains of corresponding conveyor links, with one of said chains positioned on either side of said ramp means; and
(ii) a plurality of link connecting rods extending between corresponding links on said pair of chains, each adjacent pair of connecting rods being separated a distance such that a row of said balls fits therebetween with space to allow the balls to roll, said chains and said connecting rods being drawn up the top of said ramp means and down the bottom of said ramp means and through said storage bin, with each of said rows of balls being picked up and conveyed up said ramp means between an adjacent pair of said connecting rods, and with each ball in each said row rolling up said ramp between the respective connecting rods;
(d) a brush means disposed above said inclined ramp means, said brush means contacting said balls as they roll up said ramp means;
(e) a return chute positioned between an upper end of said ramp means and said storage bin; and
(f) a gate means positioned within said return chute, said gate means being movable between a return position in which balls on said return chute are returned to said storage bin and an exit position in which balls on said return chute exit said apparatus.

2. An apparatus as in claim 1, wherein:
(a) said brush means comprises a reciprocating brush which is moved up and down and back and forth over said balls.

3. An apparatus as in claim 1, wherein:
(a) said balls are golf balls.

4. An apparatus as in claim 1, and further comprising:
(a) a source of cleaning fluid;
(b) a fluid spraying means positioned over said ramp means to spray cleaning fluid onto said balls; and
(c) means for pumping said cleaning fluid from said source to said spraying means.

5. An apparatus as in claim 4, wherein:
(a) said spraying means is positioned above said brush means on said ramp means.

6. An apparatus as in claim 4, wherein:
(a) said source of cleaning fluid comprises a tank positioned beneath said storage bin.

7. An apparatus as in claim 3, wherein:
(a) said brush means comprises a plurality of brush heads, each of which includes a plurality of individual brushes arranged across said ramp means; and
(b) means for imparting a reciprocal motion to said brush heads so that said brushes are moved up and down over said golf balls.

8. An apparatus as in claim 7, wherein said means for imparting a reciprocal motion comprises:
(a) a rotating wheel;

(b) a piston eccentrically connected at one end near the center of said wheel; and (c) arm means connected to the other end of said piston and to a support for said brushes whereby said piston moves up and down and side to side as said wheel is turned, causing said arm means and said supports to move in the same fashion, thus imparting a reciprocating up and down and side to side motion to said brush heads.

9. An apparatus as in claim 7, wherein:

(a) each of said individual brushes comprises a plurality of contiguous bristles, said bristles being graduated in length with the longest bristles being on the outside of said individual brushes and the shortest being in the center; whereby the bottoms of each of said individual brushes present a concave surface to said golf balls on said conveyor.

10. A golf ball washing apparatus comprising:

(a) an inclined ramp means;

(b) a brush means disposed above said inclined ramp means, said brush means comprising a plurality of brush heads, each of which includes a plurality of individual brushes arranged across said ramp means; and means for imparting a reciprocal motion to said brush heads so that said brushes are moved up and down over said golf balls;

(c) a ball storage bin;

(d) a conveyor means for conveying a plurality of balls to be washed up said ramp means, said conveyor means extending into said ball storage bin and picking up rows of balls therefrom, said conveyor means comprising:

(i) an opposed pair of endless chains of corresponding conveyor links, with one of said chains positioned on either side of said ramp means; and (ii) a plurality of link connecting rods extending between corresponding links on said pair of chains, each adjacent pair of connecting rods being separated a distance such that a row of said balls fits therebetween with space to allow the balls to roll, said chains and said connecting rods being drawn up the top of said ramp means and down the bottom of said ramp means and through said storage bin, with each of said rows of balls being picked up and conveyed up said ramp means between an adjacent pair of said connecting rods, and with each ball in each said row rolling up said ramp between the respective connecting rods;

(e) a source of cleaning fluid;

(f) a fluid spraying means positioned over said ramp means and above said brush means to spray cleaning fluid onto said golf balls;

(g) means for pumping said cleaning fluid from said source to said spraying means;

(h) a return chute positioned between an upper end of said ramp means and said storage bin; and (i) a gate means positioned within said return chute, said gate means being movable between a return position in which golf balls on said return chute are returned to said storage bin and an exit position in which golf balls on said return chute exit said apparatus.

11. An apparatus as in claim 10, wherein said means for imparting a reciprocal motion comprises:

(a) a rotating wheel;

(b) a piston eccentrically connected at one end near the center of said wheel; and (c) arm means connected to the other end of said piston and to a support for said brushes whereby said piston moves up and down and side to side as said wheel is turned, causing said arm means and said supports to move in the same fashion, thus imparting a reciprocating up and down and side to side motion to said brush heads.

12. An apparatus as in claim 10, wherein:

(a) each of said individual brushes comprises a plurality of contiguous bristles, said bristles being graduated in length with the longest bristles being on the outside of said individual brushes and the shortest being in the center; whereby the bottoms of each of said individual brushes present a concave surface to said golf balls on said conveyor.

13. An object washing apparatus comprising:

(a) an inclined ramp means;

(b) a conveyor means for conveying a plurality of rows of objects to be washed up said ramp means;

(c) a brush means disposed above said inclined ramp means, said brush means contacting said objects as they are conveyed up said ramp means;

(d) an object storage bin, said conveyor means extending into said storage bin and picking up said rows of objects therefrom;

(e) a return chute positioned between an upper end of said ramp means and said storage bin; and (f) a gate means positioned within said return chute, said gate means being movable between a return position in which objects on said return chute are returned to said storage bin and an exit position in which objects on said return chute exit said apparatus.

14. A golf ball washing apparatus comprising:

(a) an inclined ramp means;

(b) a conveyor means for conveying a plurality of rows of golf balls up said ramp means;

(c) a brush means disposed above said inclined ramp means, said brush means comprising a plurality of brush heads, each of which includes a plurality of individual brushes arranged across said ramp means; and means for imparting a reciprocal motion to said brush heads so that said brushes are moved up and down over said golf balls;

(d) a ball storage bin, said conveyor means extending into said ball storage bin and picking up said rows of golf balls therefrom;

(e) a source of cleaning fluid;

(f) a fluid spraying means positioned over said ramp means and above said brush means to spray cleaning fluid onto said golf balls;

(g) means for pumping said cleaning fluid from said source to said spraying means;

(h) a return chute positioned between an upper end of said ramp means and said storage bin; and (i) a gate means positioned within said return chute, said gate means being movable between a return position in which golf balls on said return chute are returned to said storage bin and an exit position in which golf balls on said return chute exit said apparatus.

* * * * *